US005490790A

United States Patent [19]

Okada

[11] Patent Number: 5,490,790

[45] Date of Patent: Feb. 13, 1996

[54] ELECTRIC VEHICLE CHARGING CONNECTOR ASSEMBLY

[75] Inventor: Hajime Okada, Yokkaichi, Japan

[73] Assignee: Sumitomo Wiring Systems, Ltd., Mie, Japan

[21] Appl. No.: 228,272

[22] Filed: Apr. 15, 1994

[30] Foreign Application Priority Data

Apr. 19, 1993 [JP] Japan ..... 5-116340

[51] Int. Cl.[6] ..... H01R 13/625

[52] U.S. Cl. ..... 439/141; 439/314

[58] Field of Search ..... 439/140, 141, 439/312–319

[56] References Cited

U.S. PATENT DOCUMENTS

| | | | |
|---|---|---|---|
| 3,711,815 | 1/1973 | Pierce et al. | 439/319 |
| 4,140,358 | 2/1979 | Marechal | 439/319 |
| 4,445,743 | 5/1984 | Bakker | 439/314 |

FOREIGN PATENT DOCUMENTS

| | | | |
|---|---|---|---|
| 503459 | 11/1921 | France | 439/314 |
| 4-124774 | 11/1992 | Japan . | |
| 4-334908 | 11/1992 | Japan . | |

*Primary Examiner*—Neil Abrams

*Attorney, Agent, or Firm*—Wenderoth, Lind & Ponack

[57] ABSTRACT

An electric vehicle charging connector assembly used for charging a power battery of an electric vehicle is disclosed. The connector assembly includes a vehicle side connector body (110) mounted on a body of the electric vehicle, vehicle side power terminals enclosed in the vehicle side connector body, an external connector body (120) configured to be mated with and unmated from the vehicle side connector body, external power terminals enclosed in the external connector body, a cam connecting mechanism disposed either on the vehicle side connector body or on the external connector body and including cam grooves (17) and cam projections receivable within the respective cam grooves, clearance grooves (18) contiguous to the respective cam grooves of the cam connecting mechanism, each clearance groove extending at the side of the external connector body relative to a final mating location of both connector bodies along a direction in which both connector bodies are mated together, a lock mechanism formed as lock grooves (19) holding both connector bodies in a mated state when both connector bodies reach the final mating location, and a return spring (25) disposed either on the vehicle side connector body or the external connector body so as to be located therebetween when both connector bodies are mated together, the return spring forcing the connector bodies apart unless the cam projections are received in the respective lock grooves.

4 Claims, 5 Drawing Sheets

ELECTRIC VEHICLE CHARGING CONNECTOR ASSEMBLY

BACKGROUND OF THE INVENTION

1 Field of the Invention

This invention relates to an electric vehicle charging connector assembly used for charging a power battery of an electric vehicle.

2. Description of the Prior Art

Social problems on environmental and energy affairs have recently produced a demand for an electric vehicle loaded with a power battery. Some types of electric vehicles have been put to practical use. The power battery provided in a body of the electric vehicle needs to be frequently charged and accordingly, an external battery charger needs to be readily connected to the power battery of the electric vehicle. Use of a connector assembly has been proposed for the purpose of connecting the battery charger and the power battery of the electric vehicle.

The connector assembly used for the above-described purpose includes a vehicle side connector body mounted on the body of the electric vehicle and vehicle side terminals enclosed in the vehicle side connector body. The terminals compose a charging power circuit. The connector assembly further includes an external connector body and external terminals enclosed in the external connector body. The external connector body is mated with and unmated from the vehicle side connector body mounted on the body of the electric vehicle so that the external terminals are connected to and disconnected from the vehicle side terminals, respectively.

Electrical connection between the terminals is unstable in the connector assembly of the above-described type in the condition that both connector bodies are not completely intermated such that the terminals are not completely interfitted. Charging in such a condition may result in an electrical disadvantage such as the generation of an arc between the terminals of both sides. However, the conventional connector assemblies are not provided by means with which an operator can see, during a mating operation, whether both connector bodies are completely interconnected. In this case, the mating operation may be completed even though both connector bodies are not completely interconnected because of failure or misjudgment by the operator and consequently, charging may be initiated by mistake.

SUMMARY OF THE INVENTION

Therefore, an object of the present invention is to provide an electric vehicle charging connector assembly wherein the operator can see, during the mating operation, whether the connector bodies are completely mated together.

The present invention resides in provision of an electric vehicle charging connector assembly externally charging a power battery provided in a body of an electric vehicle, thereby powering the electric vehicle. The connector assembly comprises a vehicle side connector body provided on the body of the electric vehicle, vehicle side power terminals enclosed in the vehicle side connector body, the vehicle side power terminals composing a charging power circuit for the power battery, an external connector body configured to be mated with and unmated from the vehicle side connector body, external power terminals enclosed in the external connector body to be electrically connected to the respective vehicle side power terminals when the external connector body is mated with the vehicle side connector body, a cam connecting mechanism provided either on the vehicle side connector body or on the external connector body so as to be located therebetween when both connector bodies are mated together, the cam connecting mechanism including cam grooves and cam projections receivable within the respective cam grooves, clearance grooves provided to be contiguous to the respective cam grooves of the cam connecting mechanism, each clearance groove extending at the side of the external connector body relative to a final mating location of both connector bodies along a direction in which both connector bodies are mated together, a lock mechanism holding both connector bodies in a mated state when both connector bodies reach the final mating location, and a return spring provided either on the vehicle side connector body or the external connector body so as to be located therebetween when both connector bodies are mated together, the return spring urging both connector bodies in a direction opposite the direction in which both connector bodies are mated together when the cam projections are received within the respective clearance grooves.

In mating both connector bodies together, the cam projections are engaged with the respective cam grooves so that the external connector body comes close to the vehicle side connector body such that both connector bodies are in a state immediately before the final mating engagement. When each cam projection reaches a beginning of the clearance groove, the vehicle side connector body is thrust against the return spring with the cam projections moving along the respective cam grooves so that it comes closer to the external connector body. Both connector bodies are in the state of the final mating engagement when each cam projection reaches the termination of the clearance groove. Subsequently, the lock mechanism is actuated to hold the connector bodies in the state of the final mating engagement. The mating operation is thus completed, and the connector bodies are completely mated together such that the terminals are completely connected together without any electrical failure.

In carrying out the above-described mating operation, the operator needs to take into consideration whether the return spring returns the vehicle side connector body back after it has been thrust forward such that each cam projection reaches the termination of the clearance groove. If the vehicle side connector body is caused to return back, the connector bodies are not completely in the state of final mating engagement since the lock mechanism is not actuated. In this case, the vehicle side connector body is again caused to mate with the external connector body and thereafter, the lock mechanism is actuated to hold both connector bodies in the state of final mating engagement. Consequently, the mating operation can be prevented from being finished before the connector bodies are not completely interconnected because of failure or misjudgment by the operator.

The present invention also provides an electric vehicle charging connector assembly comprising a vehicle side connector body provided on the body of the electric vehicle, vehicle side power terminals enclosed in the vehicle side connector body, the vehicle side power terminals forming part of a charging power circuit for the power battery, an external connector body configured to be mated with and unmated from the vehicle side connector body, external power terminals enclosed in the external connector body to be electrically connected to the respective vehicle side power terminals when the external connector body is mated with the vehicle side connector body, and vehicle side signal terminals and external signal terminals enclosed in the vehicle side connector body and the external connector body, respectively, the vehicle side and external signal terminals being electrically connected together when both connector bodies are mated together, each of the vehicle side and external signal terminals having a projecting portion projecting in the direction in which both connectors are mated together, the projecting portion of each of the vehicle side and external signal terminals having a length so set that the vehicle side and external signal terminals are connected and disconnected with a delay relative to connection and disconnection of the vehicle side and external power terminals. In this construction, the power terminal pairs are always connected together when the signal terminal pairs are connected together. Accordingly, charging can be prevented from being initiated in the state that the power terminals are not completely connected together.

BRIEF DESCRIPTION OF THE DRAWINGS

Other objects, features and advantages of the present invention will become clear upon reviewing the following description of a preferred embodiment thereof, made with reference to the accompanying drawings, in which.

DESCRIPTION OF THE PREFERRED EMBODIMENT

Figure 9:
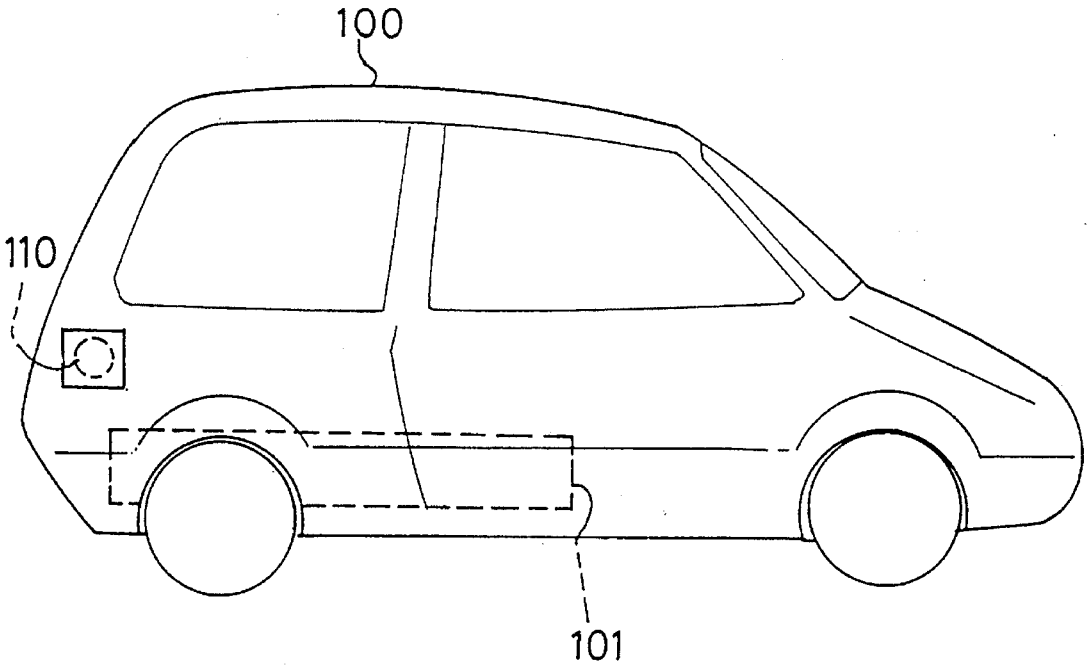
FIG. 9 is a schematic side view of an electric vehicle.

One embodiment of the present invention will be described with reference to the accompanying drawings. FIG. 9 schematically illustrates an electric vehicle. A power battery 101 is mounted in a body 100 of the electric vehicle. A vehicle side connector 110 is mounted on one side of the body 100. An external connector 120 connected to a charging power source (not shown) is to be mated with and unmated from the vehicle side connector 110.

Figure 1:
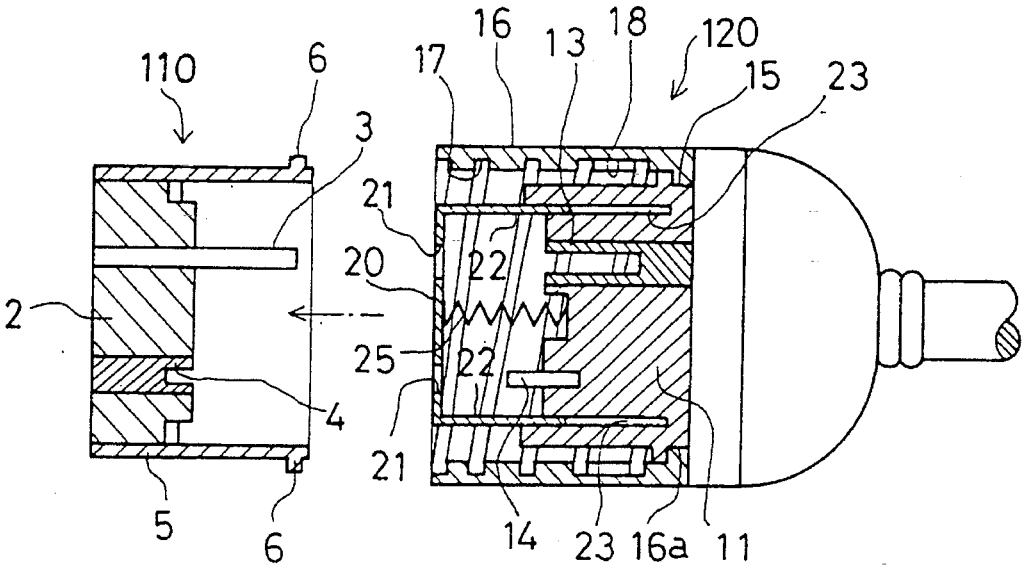
FIG. 1 is a sectional view of one embodiment of an electric vehicle charging connector assembly in accordance with the present invention, in which view both connector bodies are unmated.

Referring to FIG. 1, the vehicle side connector 110 comprises a cylindrical vehicle side connector body 5 formed of a metal and an insulator 2 disposed in the vehicle side connector body 5 and formed of a synthetic resin. Two vehicle side power terminals 3 and three vehicle side signal terminals 4 are mounted in the insulator 2. Each vehicle side power terminal 3 projects in the connector body 5 to serve as a male terminal. Each vehicle side signal terminal 4 is depressed in the insulator 2 to serve as a female terminal. The vehicle side connector body 5 has two cam projections 6 formed on an outer periphery thereof at a front end at intervals of 180 degrees.

The external connector 120 comprises an external connector body 11 formed of an electrically insulative synthetic resin, external power terminals 13 each embedded in a front wall of the connector body 11 and external signal terminals 14 projecting from the front wall of the connector body 11. The external power terminals 13 are female terminals so as to be electrically connected to the vehicle side power terminals 3 when the terminals 3 are fitted into them, respectively. The external signal terminals 14 are male terminals so as to be fitted into the vehicle side signal terminals 4, respectively. Each vehicle side power terminal 3 has a projecting portion projecting from the insulator 2 and each external signal terminal 14 also has a projecting portion projecting from the front wall of the external connector body 5. The projecting portion of each vehicle side power terminal 3 has a length longer than the projecting portion of each external signal terminal 14. Consequently, the signal terminals 4 and 14 are connected and disconnected with a delay relative to the connection and disconnection of the power terminals 3 and 13, respectively.

A cylindrical sleeve 16 formed of a metal is mounted on an outer periphery of the external connector body 11 so as to be rotatable relative thereto. The sleeve 16 projects forward of the external connector body 11 so as to surround the external signal terminals 14. The external connector body 11 has an engagement groove 15 formed in the outer periphery of the rear end thereof. The sleeve 16 has an annular limiting projection **16*a* formed on the inner periphery of the rear end thereof so that it projects inward. The limiting projection 16*a* is fitted into the engagement groove 15 of the external connector body 11 so that axial movement of the sleeve 16** is limited and its rotation is permitted.

The sleeve 16 has two spiral cam grooves 17 formed in the inner periphery thereof. The cam projections 6 of the vehicle side connector body 5 can be slidably received in the respective cam grooves 17 from the front end of the sleeve 16. Each cam groove 17 has at its rear end a clearance groove 18 extending straight in a direction in which both connectors 110 and 120 are interconnected or in a direction of the axis of rotation of the sleeve 16. Beginning portions of the clearance grooves 18 are continuous to the spiral portions of the cam grooves 17, respectively. Lock grooves 19 are formed to be continuous to terminations of the clearance grooves 18, respectively. The lock grooves 19 constitute a lock mechanism for holding both connector bodies 5, 11 when they reach a final mating position.

The power terminals 3, 13 are partially connected and the signal terminals 4, 14 are not connected when each cam projection 6 is received in the beginning portion of the clearance groove 18. The connectors 110, 120 are thus in the state of incomplete connection. When each cam projection 6 is received in the termination of the clearance groove 18, the insulators 2, 11 of the respective connectors 110, 120 collide with each other such that the power terminals 3, 13 and the signal terminals 4, 14 are completely connected, whereupon the connectors 110, 120 are in the state of final connection. Furthermore, when each cam projection 6 is received in the lock groove 19, the connectors 110, 120 are held in the final connection state, in which state the connectors 110, 120 are not unmated even when an external connecting or disconnecting force is applied to them.

A protecting plate 20 is provided in the external connector body 11 of the external connector 120. The protecting plate 20 has guide apertures 21 corresponding to the power terminals 3, 13 and the signal terminals 4, 14. The protecting plate 20 includes legs 22 inserted into positioning holes 23 formed in the external connector body 11, respectively, such that the protecting plate comes close to and moves away from the front of the external connector body 11. A return spring 25 comprising a compression coil spring is provided between the protecting plate 20 and the external connector body 11 for urging the protecting plate 20 in a direction in which the plate moves away from the connector body 11. In the state in which the connectors 110, 120 are disconnected, the return spring 25 urges the protecting plate 20 such that the external power terminals 13 and the external signal terminals 14 are covered by the protecting plate 20. Consequently, these terminals are prevented from being touched with hands or suffering from collision of a foreign object, whereby the operator or the like can be prevented from receiving an electric shock or a short circuit can be prevented.

Figure 2:
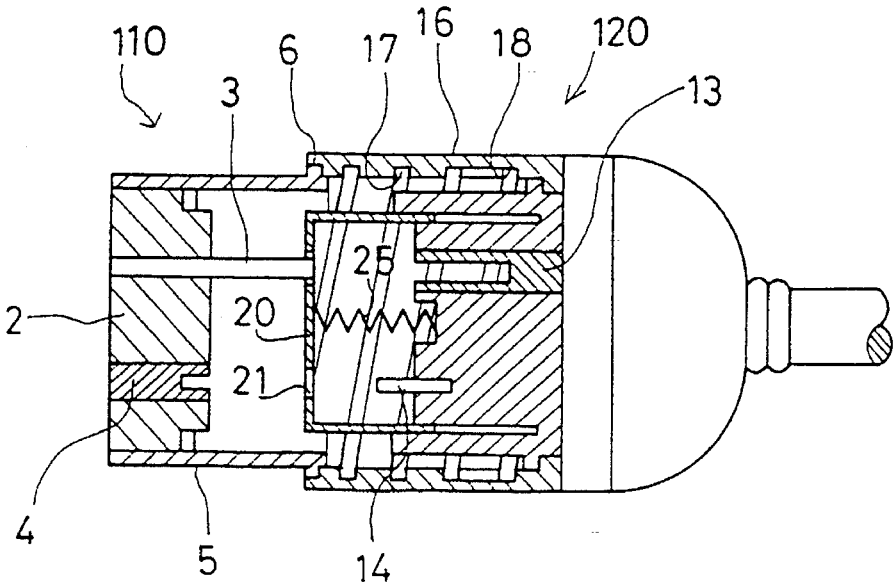
FIG. 2 is a sectional view of the connector assembly in the state in which a cam projection of the vehicle side connector body has been initially inserted into a cam groove of the external connector body.

An operation for mating the connectors together will now be described. In mating the connectors 110, 120 together, both connectors are positioned so that terminals correspond to one another. The cam projections 6 of the vehicle side connector 110 are inserted into the respective cam grooves 17, and the sleeve 16 is rotated relative to the external connector body 11 so that the external connector body 11 comes close to the vehicle side connector 110, as shown in FIG. 2. In the meantime, the cam projections 6 slide along the respective cam grooves 17 and the return spring 25 is pushed via the protecting plate 20 by the insulator 2 to be thereby compressed. The vehicle side power terminals 3 are connected to the external power terminals 13 through the guide apertures 21 of the protecting plate 20, respectively.

Figure 3:
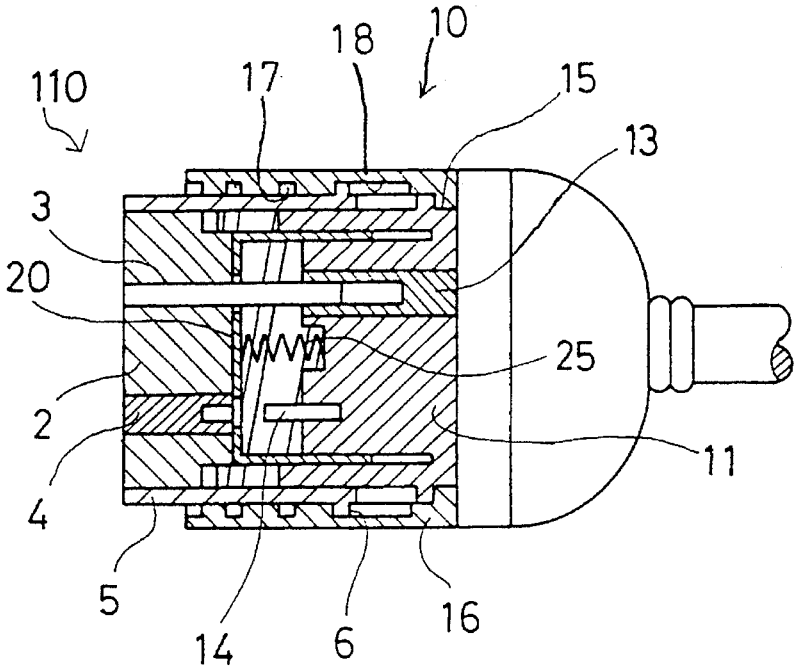
FIG. 3 is a sectional view of the connector assembly in the state in which the cam projection has reached a start of a clearance groove.

The sleeve 16 cannot be rotated when each cam projection 6 collides with the sleeve at 16 the beginning portion of the clearance groove 18. The connectors 110, 120 are in the state of incomplete connection, as shown in FIG. 3. Subsequently, the external connector body 11 is thrust straight forward toward the vehicle side connector 110 against the return spring 25 so that both connectors 110, 120 come closer to each other. In the meantime, the cam projections 6 slide along the respective clearance grooves 18 such that the return spring 25 is further compressed. Consequently, the external signal terminals 14 are connected through the guide apertures 21 of the protecting plate 20 to the vehicle side signal terminals 4, respectively.

Figure 4:
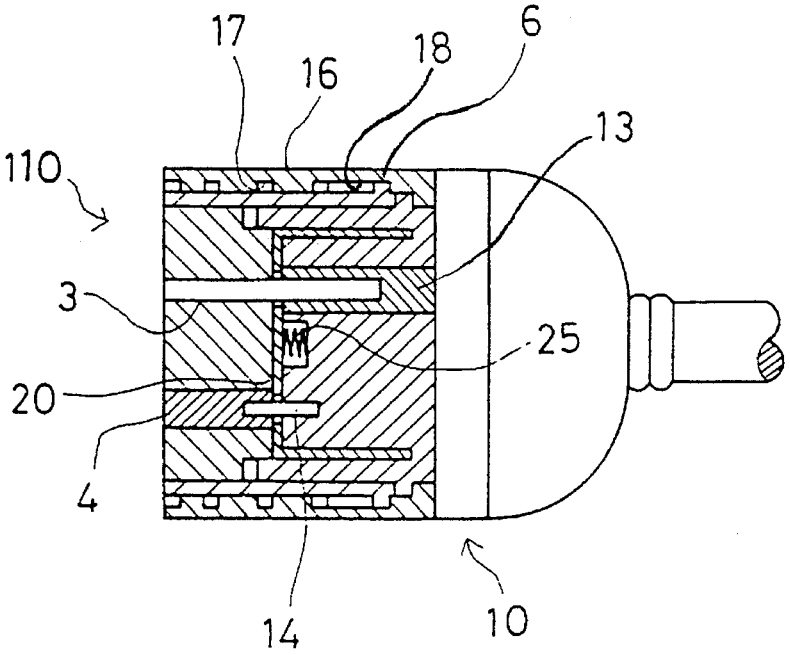
FIG. 4 is a sectional view of the connector assembly in the state in which the cam projection has reached a termination of the clearance groove such that the connectors are in the final mating engagement.
Figure 5:
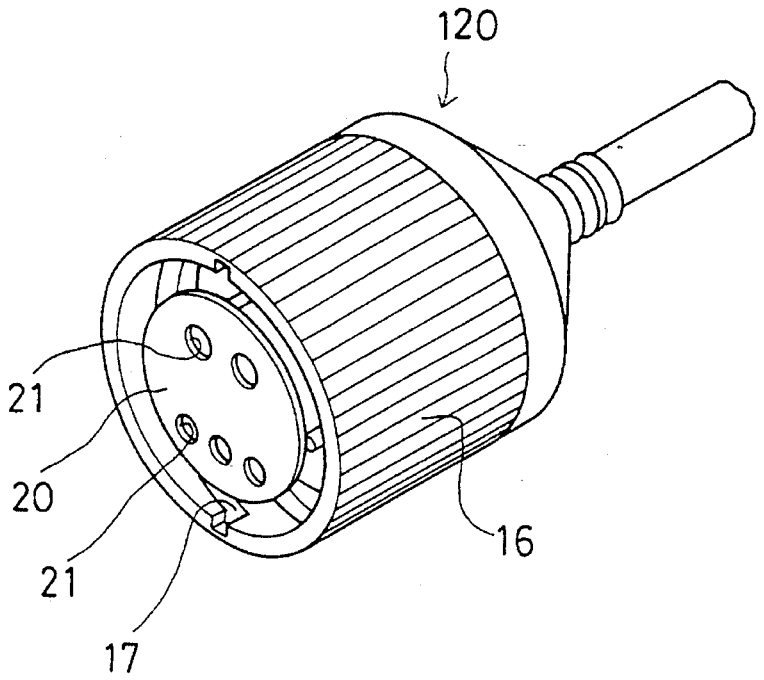
FIG. 5 is a perspective view of the external connector of the connector assembly.
Figure 6:
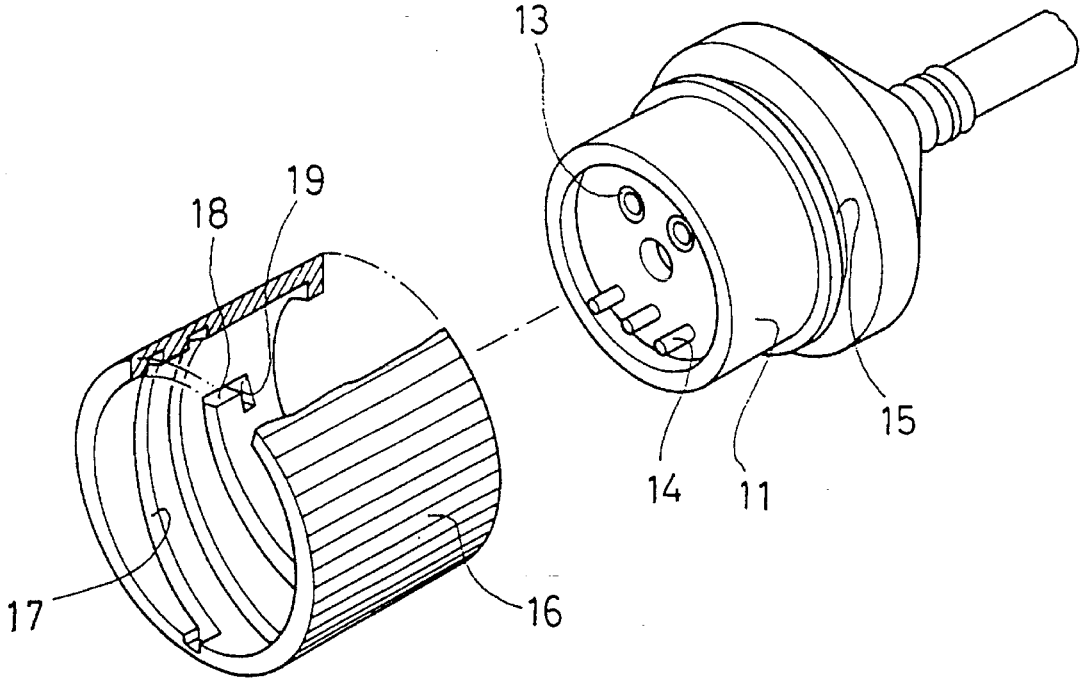
FIG. 6 is an exploded perspective view of the external connector.
Figure 7:
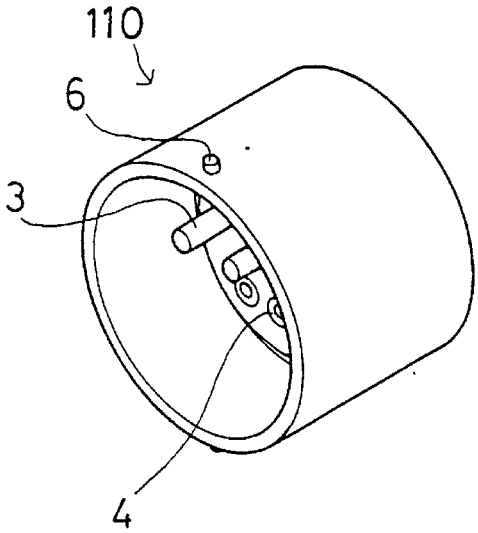
FIG. 7 is a perspective view of the vehicle side connector of the connector assembly.
Figure 8:
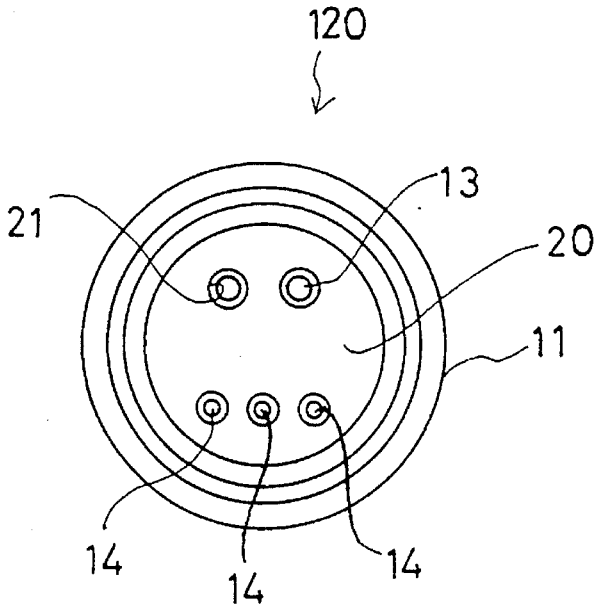
FIG. 8 is a front view of the vehicle side connector.

The external connector body 11 cannot be thrust when each cam projection 6 collides with the sleeve 16 at the termination of the clearance groove 18. The connectors 110, 120 are in the state of final connection, as shown in FIG. 4. Subsequently, the sleeve 16 is rotated in the reverse direction so that the cam projections 6 slide along the respective lock grooves 19. The mating work is completed when the cam projections 6 collide with the sleeve 16 at the terminations of the lock grooves 19, respectively, such that the sleeve 16 cannot be further rotated. In this state, the cam projections 6 are held in the respective lock grooves 19 by a frictional force due to the return spring 25 even when the operator releases his or her hold on the sleeve 16. Thus, the mating of the connectors 110, 120 is completed, and the terminals 3, 13, 4 and 14 are held in the state of complete connection without the possibility of any electrical failure. Charging is initiated upon mating of the connectors 110, 120 as described above. Upon completion of charging, the external connector body 11 is detached from the external connector 120 in a reverse order.

The operator should not stop the mating operation when the sleeve 16 has only been rotated. The operator needs to subsequently thrust the external connector body 11 toward the vehicle side connector 110, perceiving the urging force of the return spring 25. Incomplete connection of the terminals due to incomplete mating of the connectors 110, 120 can be avoided. Specifically, the urging force of the return spring 25 causes the external connector body 11 to depart from the vehicle side connector 110 when the operator does not to lock the connectors 110, 120 in the state of final connection after the external connector body 11 has been thrust toward the vehicle side connector 110. Upon confirmation of the departure of the external connector body 11 from the vehicle side connector 110, the operator can understand that the connectors 110, 120 are not locked in the state of final connection and accordingly, are in the state of incomplete connection. In this case, the external connector body 11 is thrust toward the vehicle side connector 110 and is locked. Subsequently, the operator confirms that the external connector body 11 has not returned, completing the mating operation.

According to the above-described connector assembly, the operator can see whether the connectors have been completely mated together, in the midst of the mating operation. If the mating operation is completed with the connectors in the state of incomplete connection, the connectors are maintained in the incomplete connection state when charging is initiated. However, such a situation can be avoided even when the operator is inexperienced in mating the connectors such as in the case where charging is performed at an ordinary household.

In the above-described embodiment, the projecting portion of each external signal terminal 14 is shorter than the projecting portion of each vehicle side power terminal 3. Consequently, the signal terminals 4, 14 are not connected in the incomplete connection state wherein the power terminals 3, 13 are partially interfitted, whereby the incomplete connection of the connectors is electrically detected. Consequently, a safety countermeasure can be readily taken when the connectors 110, 120 are incompletely mated together, for example, the power terminals 3, 13 are not energized.

The cam grooves 17 are formed in the inner periphery of the sleeve 16 of the external connector 120 and the cam projections 6 are formed on the outer periphery of the vehicle side connector body 5 of the vehicle side connector 110 in the foregoing embodiment. The cam grooves may be formed in the outer periphery of the sleeve 16 and the cam projections may be formed on the inner periphery of the vehicle side connector body of the vehicle side connector, instead. Furthermore, the cam grooves may be formed in the vehicle side connector body and the cam projections may be formed on the sleeve.

Although the return spring 25 is provided in the external connector 120 in the foregoing embodiment, it may be provided in the vehicle side connector body.

The cam projections 6 are received in the respective cam grooves 17 and then, the sleeve 16 is rotated for the purpose of connecting the connectors 110, 120 in the foregoing embodiment. The cam grooves may be formed in levers rotatably mounted on either connector and the cam projections may be formed on the other connector, instead. In this modified form, the action of the levers is utilized to mate the connectors together.

The foregoing description and drawings are merely illustrative of the principles of the present invention and are not to be construed fin a limiting sense. Various changes and modifications will become apparent to those of ordinary skill in the art. All such changes and modifications are seen to fall within the true spirit and scope of the invention as defined by the appended claims.

We claim:

1. An electric vehicle charging connector assembly for use in externally charging a power battery provided in a body of an electric vehicle, thereby powering the electric vehicle, the connector assembly comprising:

a) a vehicle side connector body provided on the body of the electric vehicle;

b) vehicle side power terminals disposed in the vehicle side connector body, the vehicle side power terminals forming part of a charging power circuit for the power battery;

c) an external connector configured to be mated with and unmated from the vehicle side connector body, said external connector including an external connector body;

d) external power terminals disposed in the external connector body at positions at which the external power terminals will be electrically connected to the respective vehicle side power terminals;

e) a cam connecting mechanism provided on the vehicle side connector body and on the external connector body, the cam connecting mechanism including cam grooves integral with one of said vehicle side and external connector bodies, and cam projections receivable within the respective cam grooves and integral with the other of said vehicle side and external connector bodies;

f) clearance grooves contiguous to the respective cam grooves of the cam connecting mechanism so as to receive said cam projections, respectively, after said cam projections have moved beyond said cam grooves as said connector bodies are being mated together, each of said clearance grooves extending longitudinally from one of said cam grooves in a first direction parallel to the directions in which the connector bodies move toward each other when the connector bodies are being mated together, said connector bodies reaching a final mating position after said cam projections have been slid along said clearance grooves;

g) lock means for holding said connector bodies together when said connector bodies are in said final mating position; and h) a return spring provided in one of said vehicle side connector body and said external connector at a position at which the spring will urge said connector bodies apart when said connector bodies are mated together, the return spring urging said connector bodies in directions in which the cam projections receive a force acting in a direction opposite to said first direction, in which said clearance grooves extend from said cam grooves, when the cam projections are received within the respective clearance grooves, whereby said cam projections will be moved relatively back toward said cam grooves by said return spring unless said locking means is put into effect.

2. A connector assembly according to claim 1, wherein said external connector comprises a sleeve provided on the external connector body to be fitted with the vehicle side connector body, and a limiting protrusion producing an engagement of the external connector body with the sleeve that prevents axial movement of the sleeve relative the external connector body, wherein the cam grooves are formed in an inner periphery of the sleeve and have a spiral configuration, and wherein the cam projections project from the vehicle side connector body so as to be receivable within the respective cam grooves formed in the inner periphery of the sleeve.

3. A connector assembly according to claim 1, wherein said external connector comprises a protecting plate mounted on the external connector body so as to be reciprocally movable in a direction in which the external connector body is moved relative to the vehicle side connector body when the connector bodies are being mated and a direction opposite thereto, said return spring contacting said protecting plate to urge the protecting plate in said direction in which the external connector body is moved relative to the vehicle side connector body when the connector bodies are being mated, and the protecting plate being formed of an insulative material and having apertures through which at least one of the vehicle side power terminals and external power terminals are inserted when the connector bodies are being mated.

4. A connector assembly according to claim 2, wherein said external connector comprises a protecting plate mounted on the external connector body so as to be reciprocally movable in a direction in which the external connector body is moved relative to the vehicle side connector body when the connector bodies are being mated and a direction opposite thereto, said return spring contacting said protecting plate to urge the protecting plate in said direction in which the external connector body is moved relative to the vehicle side connector body when the connector bodies are being mated, and the protecting plate being formed of an insulative material and having apertures through which at least one of the vehicle side power terminals and external power terminals are inserted when the connector bodies are being mated.

* * * * *